US005663751A

United States Patent [19]

Holbrook

[11] Patent Number: 5,663,751

[45] Date of Patent: Sep. 2, 1997

[54] AUTOMATIC SERVICE STATION FOR THE PRINTHEAD OF AN INKJET PRINTER AND METHOD FOR CLEANING THE PRINTHEAD

[75] Inventor: Russell W. Holbrook, Southbury, Conn.

[73] Assignee: Pitney Bowes Inc., Stamford, Conn.

[21] Appl. No.: 362,286

[22] Filed: Dec. 22, 1994

[51] Int. Cl.[6] ..... B41J 2/165

[52] U.S. Cl. ..... 347/22; 347/29; 347/32; 347/33

[58] Field of Search ..... 347/33, 32, 29, 347/30, 44, 22

[56] References Cited

U.S. PATENT DOCUMENTS

| | | | |
|---|---|---|---|
| 4,050,078 | 9/1977 | Isayami et al. | 346/140 R |
| 4,441,110 | 4/1984 | Hatakeyami et al. | 346/140 R |
| 4,853,717 | 8/1989 | Harmon et al. | 346/140 R |
| 5,027,134 | 6/1991 | Harmon et al. | 346/140 R |
| 5,115,250 | 5/1992 | Harmon et al. | 347/33 |
| 5,289,213 | 2/1994 | Murai et al. | 347/44 X |
| 5,300,958 | 4/1994 | Burke et al. | 346/140 R |
| 5,363,132 | 11/1994 | Ikkatai | 347/29 X |
| 5,404,158 | 4/1995 | Carlotta et al. | 347/32 |

*Primary Examiner*—John E. Barlow, Jr.
*Attorney, Agent, or Firm*—Steven J. Shapiro; Melvin J. Scolnick

[57] ABSTRACT

A service station for use in an inkjet printer having a printhead with nozzles, the service station including a carriage moveably mounted to the inkjet printer, the printhead being mounted on the carriage to be moveable therewith; a device for moving the carriage between a printhead printing position and a printhead parked position; a cap; a cap garage connected to the inkjet printer; a device for moving the cap to cover the nozzles when the carriage is moved to the printhead parked position and for moving the cap into the cap garage to be covered thereby when the carriage is moved to the printhead printing position.

13 Claims, 4 Drawing Sheets

AUTOMATIC SERVICE STATION FOR THE PRINTHEAD OF AN INKJET PRINTER AND METHOD FOR CLEANING THE PRINTHEAD

BACKGROUND OF THE INVENTION

The present invention generally relates to inkjet printing systems, and more particularly to an inkjet printing system having a printhead servicing station that is automatically actuated by movement of the printhead carriage.

The field of electronic printing has seen significant advancements made in recent years. Specifically, the technology has developed to the point where a wide variety of highly efficient printing systems are available which are capable of dispensing ink in a rapid and accurate manner. In particular, thermal and piezoelectric inkjet systems have become highly reliable and produce an excellent image. Thermal inkjet printers basically include an ink reservoir in fluid communication with a substrate having a plurality of resistors thereon. Selective activation of the resistors causes thermal excitation of the ink and expulsion thereof through nozzles of the printhead. Piezoelectric inkjet printers utilize individual piezoelectric electric elements instead of resistors. The piezoelectric elements are also selectively excited resulting in a corresponding excitation of the ink and expulsion thereof through the nozzles.

In general, in either type of inkjet printing system, an important component of the printhead is an orifice plate having a plurality of openings therein. Each opening is associated with a corresponding resistor or piezoelectric element. Upon excitation of the resistor or piezoelectric element, the ink is ejected through these openings and onto the item being printed on. Thus, the openings are in effect nozzles which emit ink. In order to ensure proper operation of the inkjet printing system, the orifice plate and openings must be kept free and clean of debris at all times. If they are not, a number of problems can occur which will impair the performance of the printer. For example, if debris such as stray paper fibers collect on the orifice plate they can reduce the quality of the formed image, cause smearing of the image, and block or interfere with expulsion of the ink through the openings in the orifice plate. Moreover, if ink is permitted to dry on the orifice plate or within the openings, the same types of problems can occur.

In order to overcome the above-mentioned problems, devices known as "service stations" have been developed. These service stations are typically positioned so that when the printhead is not in use, it is "parked" over the service station. Typical service stations can have a variety of components, but some typical maintenance functions include: a) sealing the printhead with a hermetic cap during idle time to prevent the nozzles from clogging due to ink drying over or inside of the nozzles, b) periodic wiping of the orifice plate and openings to remove dust, debris, and excess ink, c) providing an area where the printhead can spray or "purge" itself to clean the nozzles, and d) providing a controlled vacuum burst to the nozzles to clear out a clogged nozzle.

The above-mentioned service stations have primarily been designed in connection with printing devices such as typewriters and independent printers used in connection with personal computers. While the need to ensure that the printhead nozzles remain clean is important in these types of applications, it is not as critical as where inkjet printers are used in mail handling machines. Because of the ability to readily change the image printed by an inkjet printer simply through software changes, the use of inkjet printers in mailing machines is a considerable improvement over prior art rotary printing drums or conventional flat printing platens. However, the quality of the printing of postage indicia including, for example, postage value, city of origin, and zip code, is tightly controlled by the postal authorities of individual countries to deter fraudulent printing and to permit the easy reading of the indicia by postal authority automated reading equipment. Thus, in this type of environment the need to ensure the cleanliness of the printhead nozzles becomes very critical. Further compounding the problem of cleanliness is the fact that mail handling machines present a much harsher environment than the printing mechanisms previously discussed. Since high volume mail handling machines process very large numbers of mailpieces at very high speeds, the amount of paper dust created can be very significant thereby further complicating the design of an effective service station. Thus, there is a need for a service station for an inkjet printing system used in a mail handling machine which is simple in operation and which assuredly cleans the printhead nozzles despite the harsh environment associated with mail handling machines. Moreover, there is also a need for a service station which not only caps the printhead during its periods of non-use, but which covers the cap itself and the printhead wipers when each of these components are not performing their servicing function in connection with the printhead.

SUMMARY OF THE INVENTION

It is an object of the invention to provide a service station for an inkjet printer which effectively keeps the printhead nozzles clean by covering them with a cap when the printer is not printing and which covers the cap to keep it clean when the printer is printing.

The above object is met by providing a service station for use in an inkjet printer having a printhead with nozzles, the service station including: a carriage movably mounted to the inkjet printer, the printhead being mounted on the carriage to be moveable therewith; means for moving the carriage between a printhead printing position and a printhead parked position; a cap; a cap garage connected to the inkjet printer; means for moving the cap to cover the nozzles when the carriage is moved to the printhead parked position and for moving the cap into the cap garage to be covered thereby when the carriage is moved to the printhead printing position.

Yet another object of the invention is to provide a service station in which the printhead nozzles of an inkjet printer are cleaned by a wiper mechanism actuated by movement of the printhead.

The above object is met by providing a service station for use in an inkjet printer having a printhead with nozzles, the service station comprising: a carriage movably mounted to the inkjet printer, the printhead being mounted on the carriage to be moveable therewith; means for moving the carriage between a printhead printing position and a printhead parked position; a moveable wiper arm; a wiper blade connected to the wiper arm and moveable therewith;

means for moving the wiper arm such that the wiper blade sweeps across and cleans the nozzles, the wiper moving means actuated by movement of the carriage.

Yet another object of the invention is to provide a method for cleaning an inkjet printer.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF PREFERRED EMBODIMENTS

Figure 1:
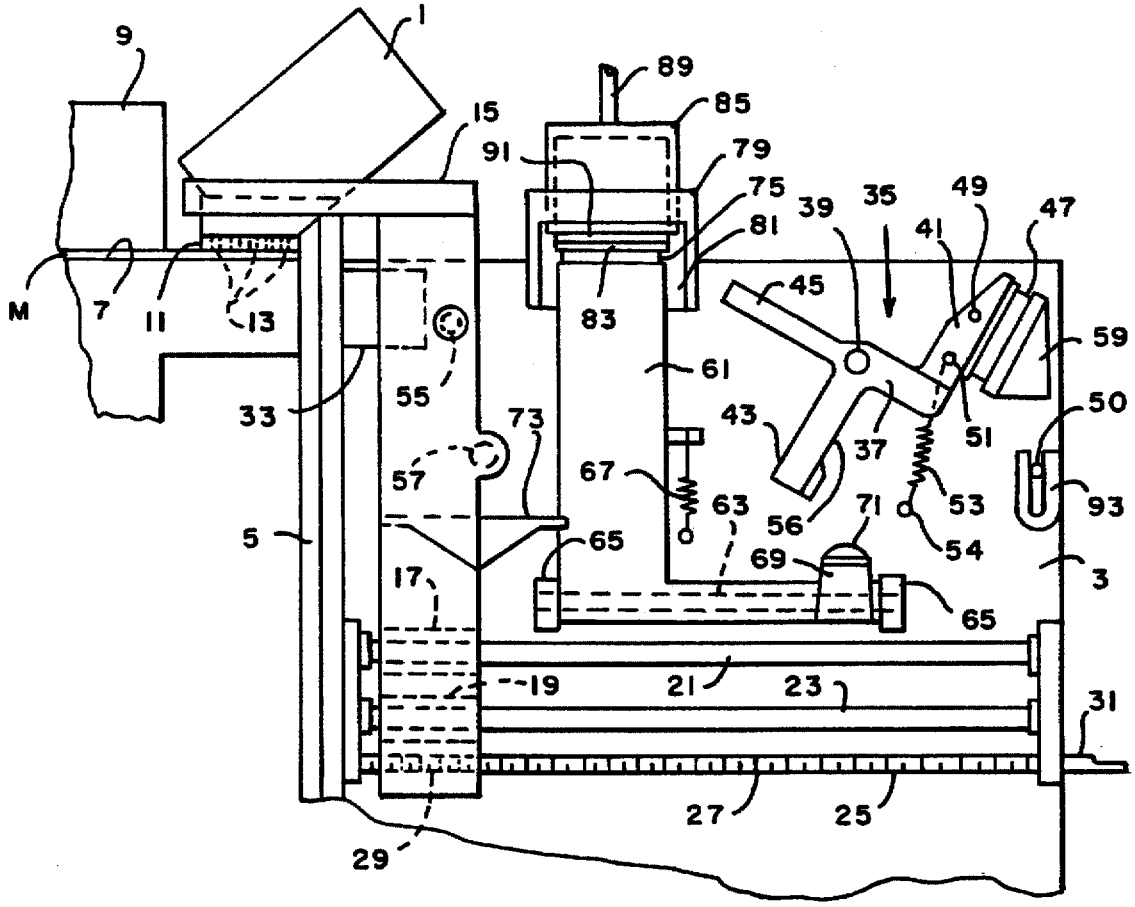
FIG. 1 shows the inventive service station in the printing position in a mail handling machine.

FIG. 1 shows a conventional inkjet printhead 1 mounted for movement within a mail handling machine. For purpose of clarity, the only portions of the mail handling machine shown are a portion of the housing 3, a rear registration wall 5 against which a mailpiece M passing through the mail handling machine is registered, a transport deck 7 over which the mailpiece is transported, and a conventional transport device 9 for moving the mailpiece over deck 7. Printhead 1 has an orifice plate 11 at a bottom portion thereof which includes a matrix of openings 13 passing therethrough via which the controlled expulsion of ink takes place in a conventional manner. As shown in FIG. 1, the printhead is located at a print station where it can be energized to print indicia on mailpiece M passing over deck 7.

Printhead 1 is mounted to a carriage 15 in a conventional manner to be moveable therewith. Carriage 15 has a pair of linear bearings 17,19 disposed therein which ride on respective shafts 21,23. Shafts 21,23 are fixedly mounted in housing 3 in any conventional manner. Also mounted for rotation within housing 3 is a ball or acme screw 25. Screw 25 has a threaded portion 27 extending over most of its length which engages with corresponding threads 29 of carriage 15. A portion 31 of screw 25 is directly connectable to a motor (not shown) for driving screw 25 into rotation in either direction, or to other conventional drive systems such as those used in driving other components of the mail handling machine. When screw 25 is forced to rotate, carriage 15 correspondingly moves along screw 25 and also along shafts 21, 23 via linear beatings 17, 19. Thus, depending on the direction of rotation of screw 25, carriage 15 can be made to traverse between the printing position of FIG. 1 and the capped position of FIG. 5. Moreover, by using conventional control mechanisms the printhead can be stopped at any position along the shafts 21, 23.

A spittoon or reservoir 33 is connected to housing 3 such that the printhead 1 can be stopped and positioned directly thereabove. In this "purging" position, printhead 1 can be energized to emit a controlled mount of ink into the spittoon 33 to clear and/or clean the openings (nozzles) 13. The spittoon 33 can be removably mounted in the housing 3 or could have a hose extending therefrom which leads to another reservoir for containing the ink emitted from the printhead 1 at the purging position.

Figure 6:
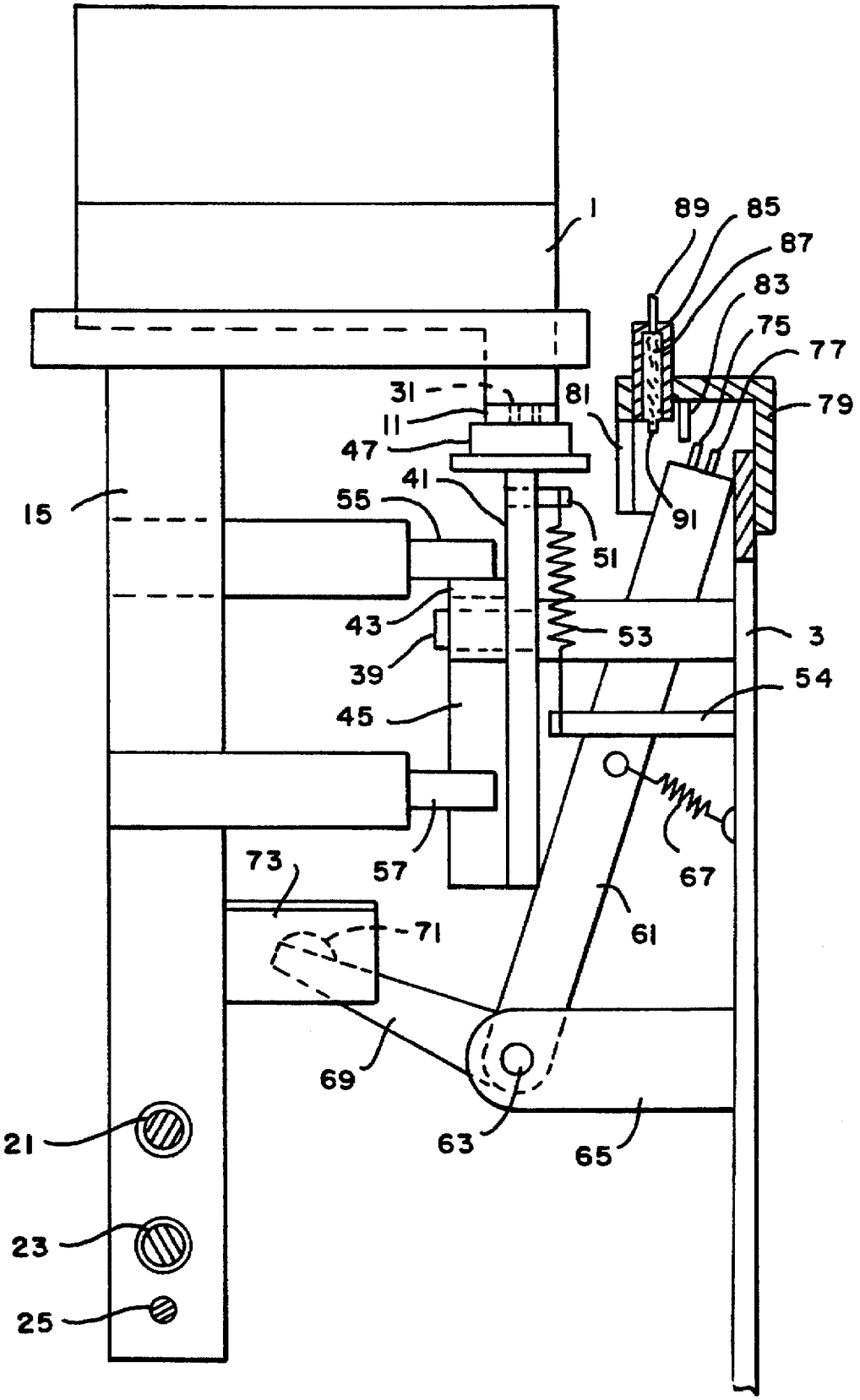
FIG. 6 is an enlarged view of the service station as viewed from the right of FIG. 5.

Referring to FIGS. 1 and 6, a capping mechanism is generally indicated at 35. Capping mechanism 35 includes a cap arm 37 pivotably mounted to housing 3 via a spindle 39. Cap arm 37 includes first, second, and third major portions 41,43,45. First portion 41 has a cap 47 extending therefrom. A vacuum port 49 extends through first portion 41 and into cap 47 and is connectable with a vacuum hose 50 in communication with a vacuum source (not shown). A projection 51 also extends from first portion 41 and is used to connect a first end of spring 53 thereto. A second end of spring 53 is connected to housing 3 in a conventional manner such as being hooked around a projection or hook 54 extending from housing 3. When connected to projections 51,54, spring 53 exerts a biasing force on arm 37 tending to force it into rotation around spindle 39 in a direction dependent upon the position of first portion 41 as will be described in more detail hereinbelow.

Second portion 43 has a cap arm cam surface 56 extending along its length which cooperates with a capping pin 55 extending from carriage 15 for a purpose to be discussed below. Moreover, a cap arm pin 57 extends from carriage 15 and operatively interacts with second and third portions 43,45 as discussed below.

The inventive apparatus also includes a cap housing 59 which is fixedly mounted to housing 3 in a position which allows cap 47 to be contained therein when cap 47 is not in use for covering the orifice plate 11 and openings 13 of the printhead 1. This position of cap 47 is very important and is shown in FIG. 1. That is, when the printhead 1 is in the printing position, cap 47 is itself capped by housing 59 to insure that, for example, paper dust generated by the mailing machine is not trapped within cap 47 where it could subsequently be transferred to the orifice plate 11 when cap 47 is moved to cover the printhead 1.

Referring to FIGS. 1 and 6, the invention also includes a wiper arm 61 pivotally mounted about a shaft 63 supported at each end by collars 65. A biasing spring 67 is connected between wiper arm 61 and housing 3 in order to bias wiper arm 61 into the position of FIG. 6. Wiper arm 61 also has a cantilevered portion 69 extending therefrom with a wiper arm cam follower 71 projecting from an end of cantilevered portion 69. Cam follower 71 operatively interacts with a carriage cam 73 extending from carriage 15 for a purpose to be discussed below.

Referring to FIG. 6, wiper arm 61 has a pair of wiper blades 75, 77 extending from a top portion thereof which are used to sweep across orifice plate 11 of printhead 1 in order to clean orifice plate 11 in a manner addressed in more detail below. Wiper blades 75,77 are preferably a single piece construction and made of resilient, non-abrasive, elastomeric materials (or other comparable material known in the art). Moreover, wiper blades 75,77 are dimensioned to be at least as wide as orifice plate 11 to ensure complete cleaning thereof by the passage of blades 75,77 over orifice plate 11. When wiper blades 75,77 are not performing there cleaning function, they are positioned, as shown in FIG. 6, within a garage 79 connected to housing 3. Garage 79 is a box-like structure which is open at the bottom and which has an opening 81 in a front wall thereof through which wiper arm 61 and blades 75,77 can pass as they are rotated about shaft 63. Thus, garage 79 is a capping device for the wiper blades 75,77 when they are not being used to clean printhead 1. Garage 79 helps to prevent any debris produced in the mail handling machine from being deposited on wiper blades 75,77 so that these blades do not become dirty and contaminate instead of clean printhead 1. The garage 79 also includes a blade cleaner 83 mounted on an inside portion thereof. The blade cleaner 83 which may be a foam or plastic material interferes with wiper blades 75,77 as they rotate into garage 79 thereby cleaning wiper blades 75,77. Garage 79 also includes a cleaning solution storage chamber 85 which, as shown in the preferred embodiment, is integrally formed as part of garage 79. Storage chamber 85 includes an absorbent member 87 therein preferably made of polyurethane foam, cotton, or other absorbent materials known in the art. Absorbent member 87 is saturated with cleaning solution known in the art via a port 89 in a top portion of chamber 85. Each time wiper arm 61 is rotated out of garage 79 (as further discussed below) wiper blades 75,77 are first wiped clean by contact with blade cleaner 83 and then provided with cleaning solution via contact with a tip portion 91 of absorbent material 87.

While the above discussion set forth the structural components of the invention, a discussion of the actual operation of the apparatus will now follow with specific reference to FIGS. 1–6. As previously discussed, FIG. 1 shows the printhead 1 in its print position. In this position spring 53 has biased cap 47 into cap housing 59 to prevent cap 47 from becoming contaminated with debris. Similarly, wiper arm 61 is biased by spring 67 such that wiper blades 75,77 are housed in garage 79 to keep them clean.

Figure 2:
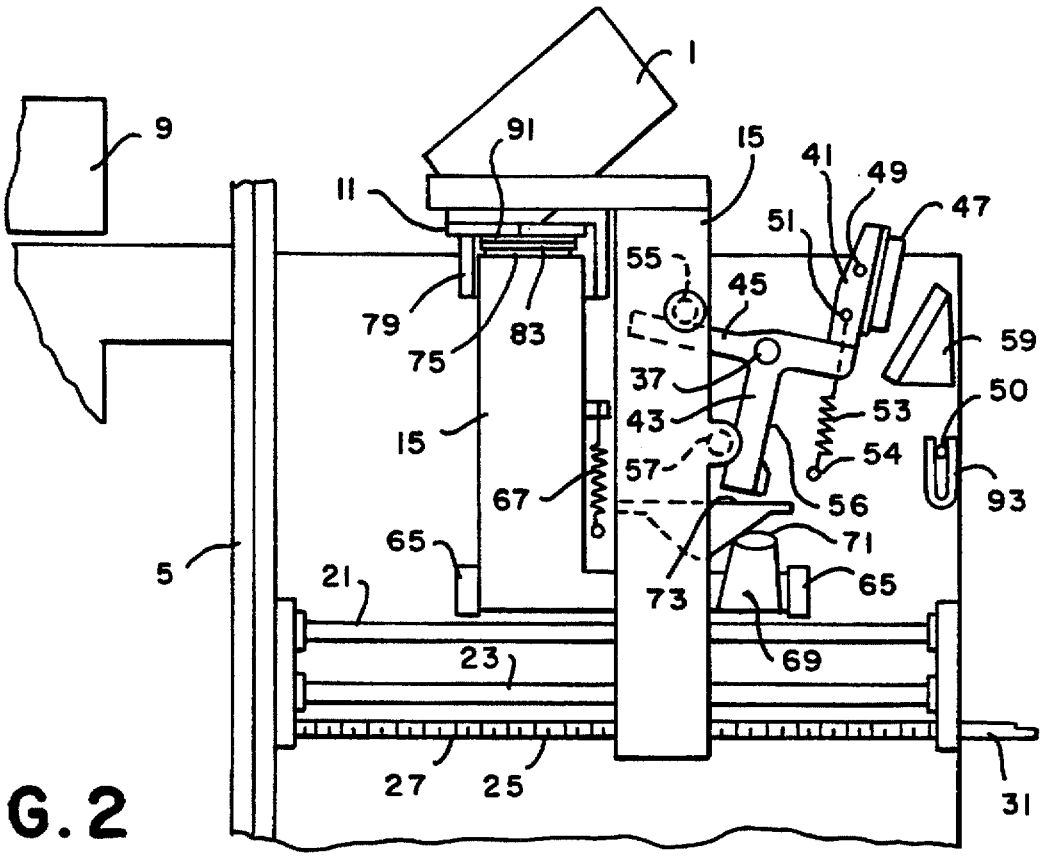
FIG. 2 is the same as FIG. 1 but showing the service station just prior to wiping of the printhead.

FIG. 2 shows that carriage arm 15 has been moved via ball screw 25, linear bearings 17, 19, and shafts 21,23 to a position just prior to actuation of wiper arm 61. That is, carriage cam 73 is in a position just prior to making contact with wiper arm cam follower 71. Thus, at this point wiper blades 75,77 are still housed in garage 79. However, as carriage 15 continues to move to the right in FIG. 2, carriage cam 73 will contact wiper arm cam follower 71 such that cam follower 71 will follow the profile of carriage cam 73 forcing wiper arm 61 to move towards printhead 1 (to the left in FIG. 6) via its rotation about shaft 63. It is also important to note that in FIG. 2, carriage arm pin 57 has already contacted arm portion 43 of arm 37 such that arm 37 has been rotated in a counterclockwise direction about spindle 39. Cap 47 has therefore correspondingly been rotated out of cap housing 59.

Figure 3:
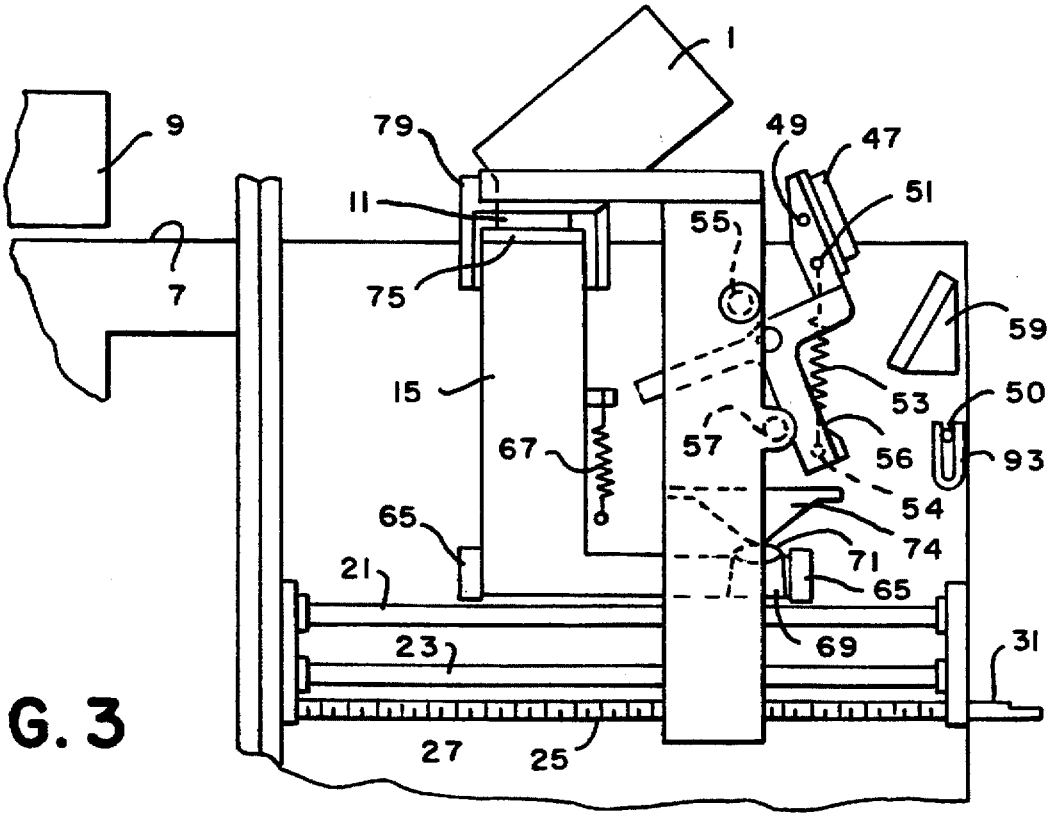
FIG. 3 is the same as FIG. 1 but showing the service station just after the completion of the wiping of the printhead.

FIG. 3 shows the printhead 1 in the position where wiping of wiper blades 75,77 across orifice plate 11 has been completed. Carriage cam 73 has a bottom most portion in contact with cam follower 71 such that wiper arm 61 has rotated counterclockwise (as viewed in FIG. 6) to a position whereby wiper blades 75,77 have been swept across orifice plate 11. Furthermore, arm 37 has been further rotated in the clockwise direction (FIG. 3) due to the interaction between cap arm pin 57 and first portion 43.

Figure 4:
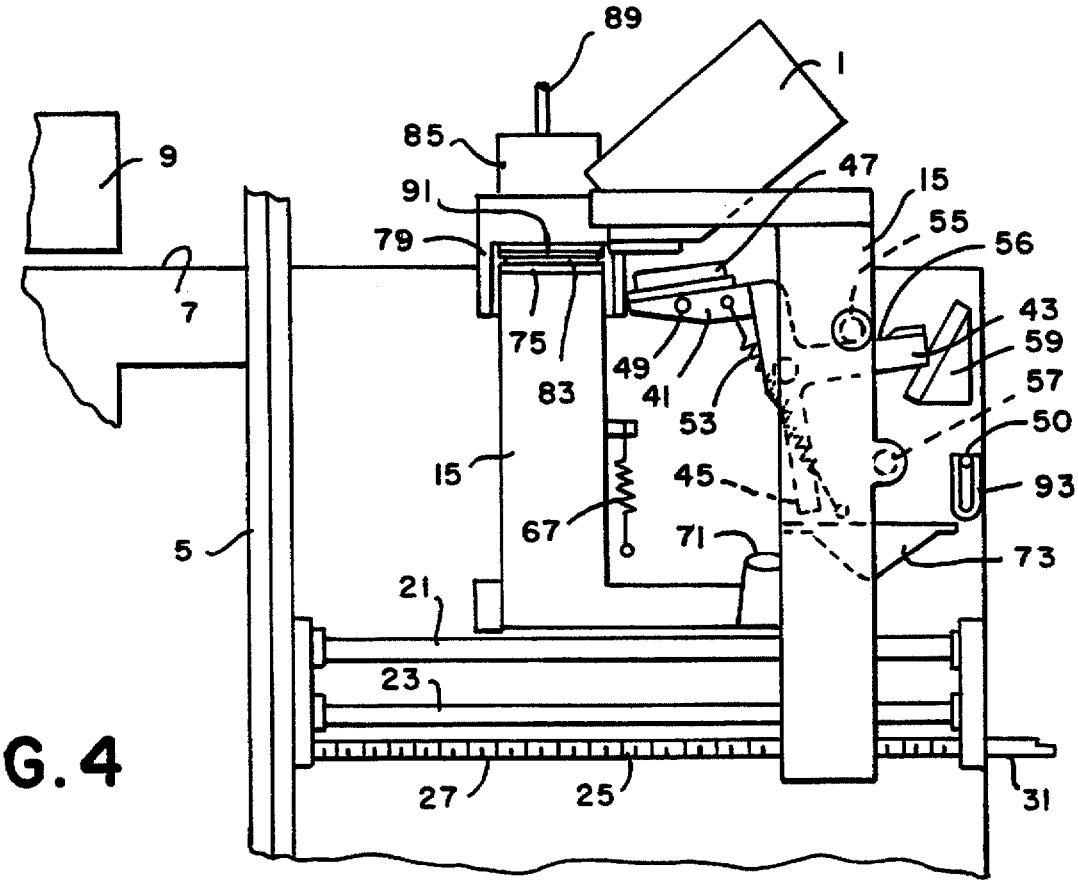
FIG. 4 is the same as FIG. 1 but showing the service station just prior to the printhead being capped.

FIG. 4 shows the inventive apparatus in the position just prior to capping of the printhead 1. Carriage 15 has been moved to a point where spring 53 now acts to bias arm 37 in the counterclockwise direction pulling cap 47 beyond a horizontal position. However, capping pin 55 is now in a position to interact with cam surface 56. Moreover, since carriage cam 73 no longer contacts cam follower 71, wiper arm 61 is forced to rotate back into the position of FIG. 6 due to the biasing force of spring 67.

Figure 5:
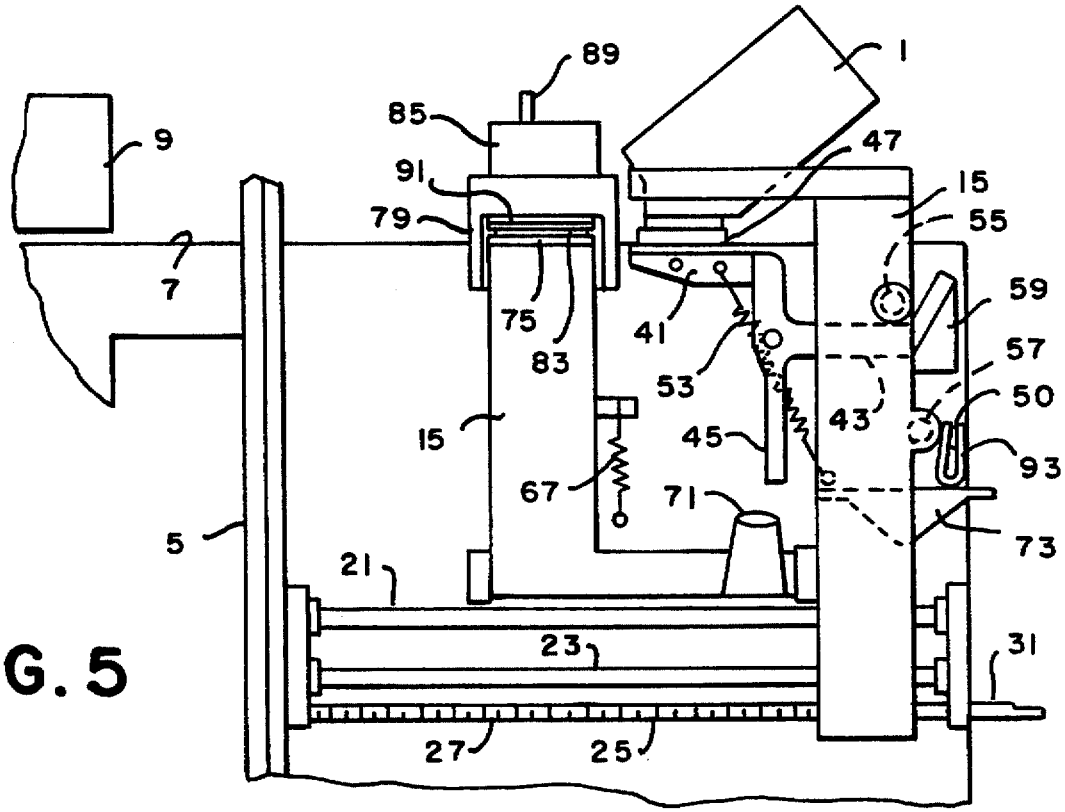
FIG. 5 is the same as FIG. 1 but showing the printhead as being capped.

FIG. 5 shows the printhead 1 in the capped position. That is, capping pin 55 has engaged cam surface 56 forcing arm 37 to rotate in a clockwise direction against the force of biasing spring 53 such that cap 47 engages with orifice plate 11. Cap 47 is designed in a conventional manner such that its surrounding wall portion 85 flexibly receives and surrounds orifice plate 11 to create a hermetic seal thereabouts which prevents any debris from contaminating printhead 1. Moreover, a hose clamp 93 is attached to housing 3. Hose clamp 93 has the vacuum hose 50 passing therethrough which is connected at one end (though not shown) to vacuum port 49 and at the other end to a vacuum source (not shown). Thus, if a vacuum purge of the printhead, 1 is required in the capped position, cap arm pin 57 pinches the hose clamp 93 and correspondingly vacuum hose 50 allowing the vacuum source to draw down a vacuum on a portion of the vacuum hose 50 between the hose clamp 93 and the vacuum source. When a sufficient vacuum has been achieved, carriage 15 can be moved slightly forward to unclamp hose 50 such that a controlled vacuum can be applied to the openings 13 to either clean the openings 13 or facilitate initial printhead start-up.

It is obvious to one possessing ordinary skill in the art that as the carriage is subsequently returned to the print position of FIG. 1, wiper arm 61 will be actuated to sweep wiper blades 75,77 across orifice plate 11 due to the interaction of carriage cam 73 and cam follower 71. Thus, orifice plate 11 is cleaned twice when moving back and forth between its printing and capped positions. Moreover, as carriage 15 returns to the print position, capping arm pin 57 will engage third arm portion 45 until arm 37 is repositioned such that spring 53 biases arm 37 to rotate in the clockwise direction (in FIG. 1) into cap housing 59.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A service station for use in an inkjet printer having a printhead with nozzles, the service station comprising:

a carriage moveably mounted to the inkjet printer, the printhead being mounted on the carriage to be moveable therewith;

means for moving the carriage between a printhead printing position and a printhead parked position;

a cap;

a cap cover connected to the inkjet printer;

means for moving the cap to cover the nozzles when the carriage is moved to the printhead parked position and for moving the cap into the cap cover to be covered and capped thereby when the carriage is moved to the printhead printing position so that the cap is not contaminated with debris when covered by the cover.

2. A service station as recited in claim 1, wherein the cap moving means is actuated by movement of the carriage.

3. A service station as recited in claim 2, wherein the cap moving means includes a cap arm pivotably mounted to the inkjet printer, a cap arm pin extending from the carriage, and a capping pin extending from the carriage, and wherein the cap is connected to the cap arm to move therewith, the cap arm pin interferes with the cap arm during movement of the carriage forcing the cap arm to pivot away from the cap cover and the capping pin interferes with the cap arm during movement of the carriage forcing the cap arm to pivot toward the cap cover.

4. A service station as recited in claim 3, further comprising a biasing spring, connected between the inkjet printer and the cap arm, which biases the cap arm to move the cap toward the cover when the cap arm is in a first position and which biases the cap arm to move the cap away from the cap cover when the cap arm is in a second position.

5. A service station as recited in claim 4, wherein during movement of the carriage from the printhead printing position to the printhead parked position the cap arm pin interferes with the cap arm to move the cap arm from the first position to the second position whereby the biasing spring then moves the cap arm into engagement with the capping pin such that further movement of the carriage toward the printhead parked position results in the capping pin forcing the cap arm to pivot back toward the first position such that the cap covers the nozzles.

6. A service station as recited in claim 5, wherein during movement of the carriage from the printhead parked position to the printhead printing position the cap arm pin interferes with the cap arm moving the cap arm to the first position whereby the biasing spring biases the cap into the cover.

7. A service station as recited in claim 1, further comprising a wiper arm having at least one wiper blade extending therefrom, and means for moving the wiper arm such that the wiper blade sweeps across and cleans the nozzles, wherein the wiper arm moving means is actuated by movement of the carriage.

8. A service station as recited in claim 1, further comprising a vacuum hose, and a holder in which the vacuum hose is disposed, and wherein the cap includes a vacuum port which is connected to a first end of the vacuum hose, and during movement of the carriage into the printhead parked position the carriage squeezes the holder and the vacuum hose contained therein allowing a vacuum source to draw a vacuum on a portion of the vacuum hose between the holder and a second end of the vacuum hose.

9. A service station for use in an inkjet printer having a printhead with nozzles, the service station comprising:

a carriage movably mounted to the inkjet printer, the printhead being mounted on the carriage to be moveable therewith;

means for moving the carriage between a printhead printing position and a printhead parked position;

a moveable wiper arm;

a wiper blade connected to the wiper arm and moveable therewith;

means for moving the wiper arm such that the wiper blade sweeps across and cleans the nozzles, the wiper moving means actuated by movement of the carriage;

wherein the wiper arm moving means further comprises a cam extending from the carriage and a cam follower extending from the wiper arm, and during movement of the carriage between the printhead printing and parked positions the cam and cam follower interact causing the wiper arm to move such that the wiper blade sweeps across and cleans the nozzles.

10. A service station as set forth in claim 9, wherein the wiper arm is mounted to the inkjet printer for pivoting movement at times when the wiper arm moving means is actuated by movement of the carriage.

11. A service station as recited in claim 9, further comprising a housing connected to the inkjet printer, the housing houses and protects the wiper blade at times when the wiper arm moving means is not actuated by movement of the carriage.

12. A service station as recited in claim 11, further comprising means for biasing the wiper arm such that the wiper blade is housed and protected within the housing at times when the wiper arm moving means is not actuated by movement of the carriage.

13. A method for maintaining a cap of an inkjet printer, the inkjet printer having a moveable printhead with nozzles thereon, the method comprising the steps of:

a) moving the printhead to a parked position;

b) moving the cap to cover the printhead in the parked position;

c) moving the printhead out of the parked position;

d) moving the cap into a cover thereby capping the cap with the cover such that the cover is covering and protecting the cap from being contaminated with debris.

* * * * *